United States Patent [19]

Crow

[11] 3,980,411

[45] Sept. 14, 1976

[54] AERODYNAMIC SEAL FOR A ROTARY MACHINE

[75] Inventor: David Edward Crow, Glastonbury, Conn.

[73] Assignee: United Technologies Corporation, Hartford, Conn.

[22] Filed: Oct. 20, 1975

[21] Appl. No.: 624,205

[52] U.S. Cl. ..... 415/1; 415/115; 415/175; 277/57

[51] Int. Cl.[2] ..... F01D 11/10

[58] Field of Search ..... 415/1, 115, 116, 175; 277/57, 71; 60/39.66

[56] References Cited

UNITED STATES PATENTS

| | | | |
|---|---|---|---|
| 2,463,898 | 5/1949 | Moore | 415/175 |
| 2,988,325 | 6/1961 | Dawson | 415/115 |
| 3,174,719 | 3/1965 | Sproule et al. | 277/72 |
| 3,535,873 | 10/1970 | Syzdlowski | 60/39.66 |
| 3,619,076 | 11/1971 | Kydd | 415/115 |
| 3,635,586 | 1/1972 | Kent et al. | 415/115 |
| 3,768,921 | 10/1973 | Brown et al. | 415/116 |
| 3,791,758 | 2/1974 | Jenkinson | 415/116 |
| 3,826,084 | 7/1974 | Branstrom et al. | 415/175 |
| 3,936,215 | 2/1976 | Hoff | 415/115 |

FOREIGN PATENTS OR APPLICATIONS

| | | | |
|---|---|---|---|
| 766,883 | 1/1957 | United Kingdom | 415/115 |

*Primary Examiner*—C. J. Husar
*Attorney, Agent, or Firm*—Robert C. Walker

[57] ABSTRACT

A rotary machine, such as a gas turbine engine, capable of reliable operation with improved overall cycle efficiency is disclosed. Various construction details which aerodynamically isolate internal cavities of the machine from the flow path for the working medium gases are developed. A sealing system built around the use of free vortex phenomenon reduces the amount of air which must be flowed through the cavity to prevent ingestion of the working medium gases into the cavity.

7 Claims, 4 Drawing Figures

AERODYNAMIC SEAL FOR A ROTARY MACHINE

BACKGROUND OF THE INVENTION

1. Field of the Invention

The present invention relates to rotary machines and particularly to sealing of a medium flow path within the machine.

2. Description of the Prior Art

The design and construction of efficient rotary machines, and of gas turbine engines in particular, has historically required careful confinement of the working medium gases to the flow path of the machine to preserve aerodynamic performance and to protect the internal components of the machine from thermal degradation.

Typical construction details in a region radially inward of the working medium flow path of a gas turbine engine are shown in U.S. Pat. No. 3,515,112 to Pettengill entitled "Reduced Clearance Seal Construction." In a Pettengill type construction the radially inward ingestion of working medium gases into the internal regions of the machine is prevented by flowing air radially outward between the stator or stationary element and the rotor or rotating element of the machine. The air flowed outwardly is termed purge air and is supplied to the cavity at a pressure greater than the pressure of the local working medium gases in the flow path. The rate of flow of the purge air through the cavity is set by the minimized combination of pressure differential and flow area between the purge supply and the flow path. For example, if the minimized flow conditions in the Pettengill construction occur across the labyrinth seal, the rate of flow across the seal will establish the rate of flow through the cavity. Similarly, if the minimized conditions of pressure differential and area occur across the narrow passage between the relatively rotating components at the disk rim, the flow rate through the cavity will be restricted by the flow rate through the passage.

Within the cavity the purge air adjacent the rotating member is pumped radially outwardly in response to frictional forces between the air and the radially extending surfaces of the rotor. If the pumping rate exceeds the rate at which purge air is supplied through the labyrinth seal, a circulation zone is established within the cavity. The excess of pumped air over purge air is forced across the passage leading to the working medium flow path and radially inward along the stationary member. As the circulating air travels across the passage, a portion of the working medium gases is ingested and circulated with the cavity air. As this occurs, the temperature of the air within the cavity becomes elevated and the durability of the local components becomes adversely effected.

New concepts are continually sought within the rotary machinery art to minimize the performance losses inherently imposed upon the machine by flowing substantial amounts of purge air between the relatively rotating components to prevent ingestion of the working medium gases.

SUMMARY OF THE INVENTION

A primary aim of the present invention is to improve the operating efficiency of a gas turbine engine. Minimizing the amount of purge air required to prevent the ingestion of working medium gases into internally located cavities is one goal. In furtherance of the stated primary aim, a reduction in the radial outflow of air through various boundary layers is desired and, in one aspect, a specific object is to invert the radial pressure gradient conventionally imposed upon the boundary layer by internal pressure forces within the cavity. A concomitant aim is to increase the clearance between the rotating and the stationary elements of a rotary machine without adversely affecting performance or durability.

According to the present invention air within a cavity which is formed between a rotating element and a stationary element of a rotary machine is accelerated to a tangential velocity which approximates the tangential velocity of the rotating element at a corresponding radial position.

A primary feature of the present invention is the air injection nozzle which is oriented so as to discharge the air flowing therefrom in the direction of rotation of the rotating element. In one embodiment the nozzle is canted radially inward so as to impart an inward velocity component to the air flowing therethrough. Another feature of the present invention is the substantial clearance between the rotating element and the stationary element of the machine at the outer end of the cavity.

A principal advantage of the present inventon is increased cycle efficiency which results from a reduction in the amount of purge air which must be flowed through the cavity to prevent the ingestion of working medium gases. Additionally, the clearance between the rotating and stationary elements of a gas turbine engine in the region of the disk rim is increased to insure that destructive interference between the relatively rotating elements does not occur. The durability of the components adjacent to the cavity is increased through a reduction in the cavity temperature as the ingestion of medium gases is stopped.

The foregoing, and other objects, features and advantages of the present invention will become more apparent in the light of the following detailed description of the preferred embodiment thereof as shown in the accompanying drawing.

DESCRIPTION OF THE PREFERRED EMBODIMENT

Figure 1:
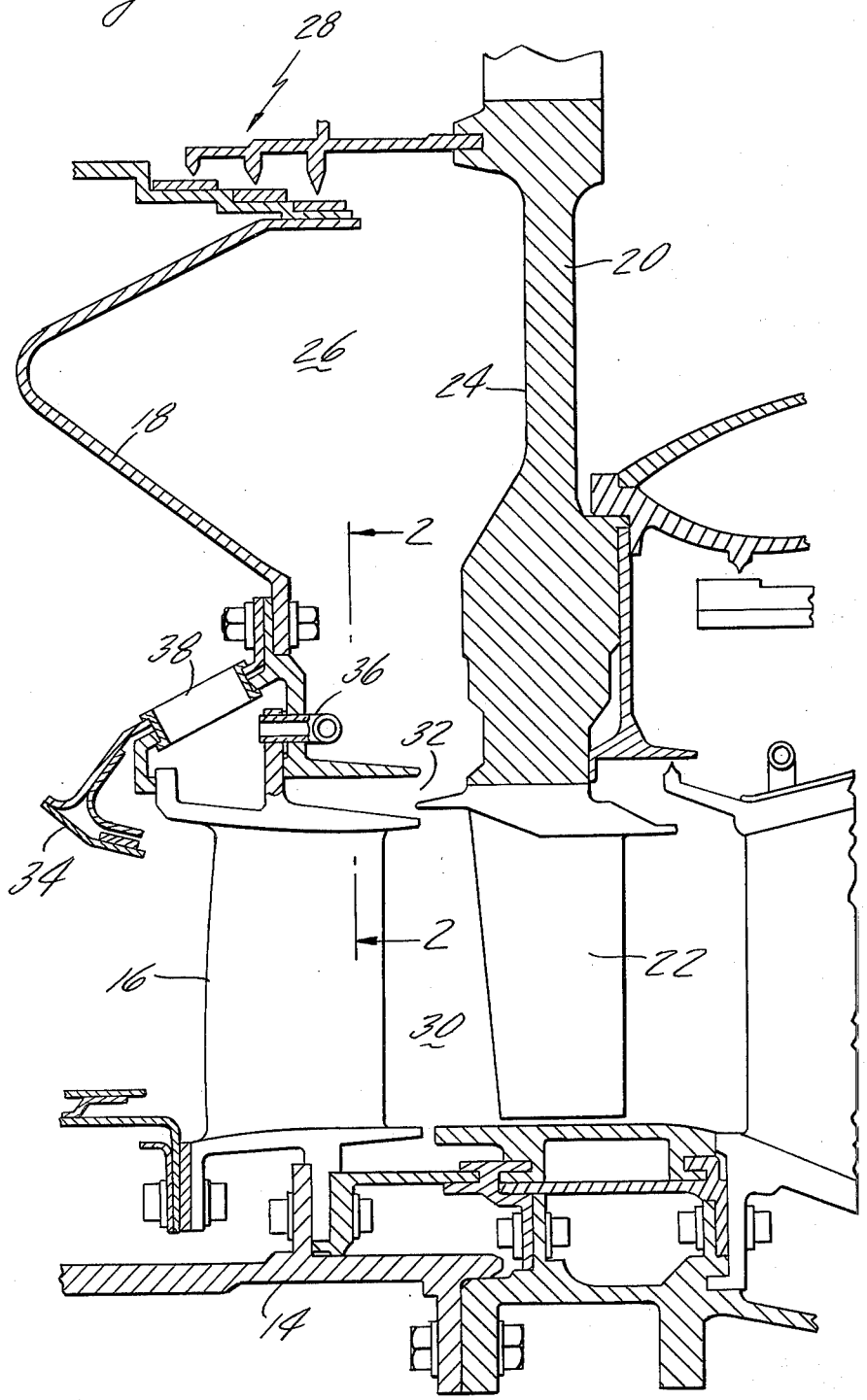
FIG. 1 is a simplified cross section view of the portion of the turbine section of a gas turbine engine.
Figure 2:
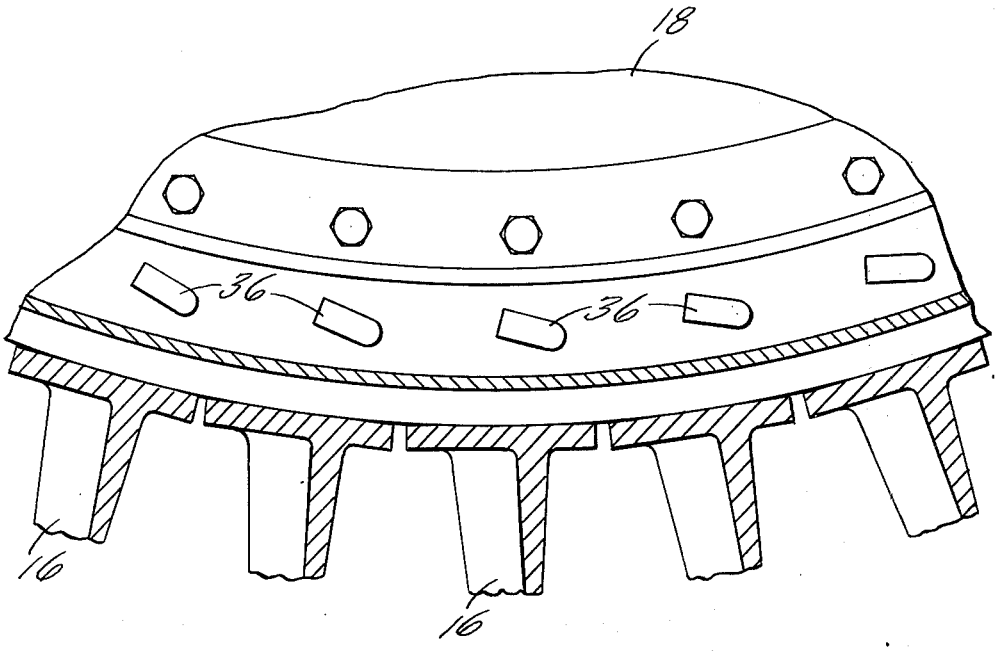
FIG. 2 is a sectional view taken along the line 2—2 as shown in FIG. 1.
Figure 4:
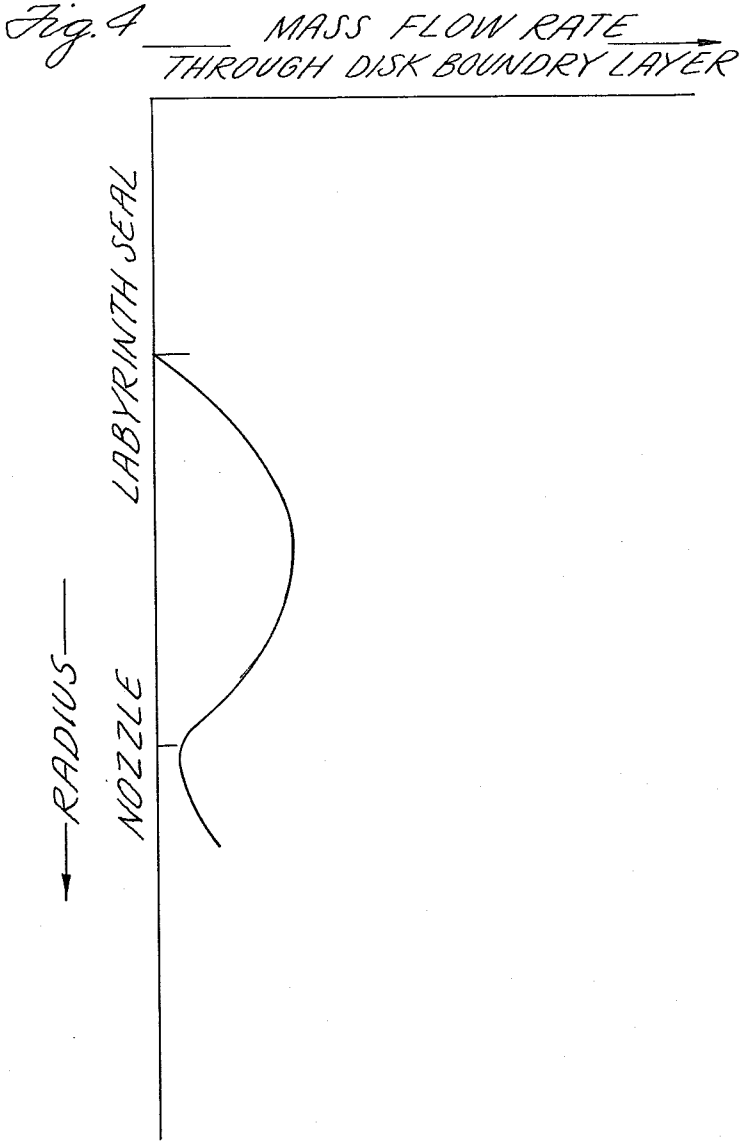
FIG. 4 is a graph showing the relationship between radius and the mass flow rate of air through the boundary layer adjacent the rotating element.
Figure 3:
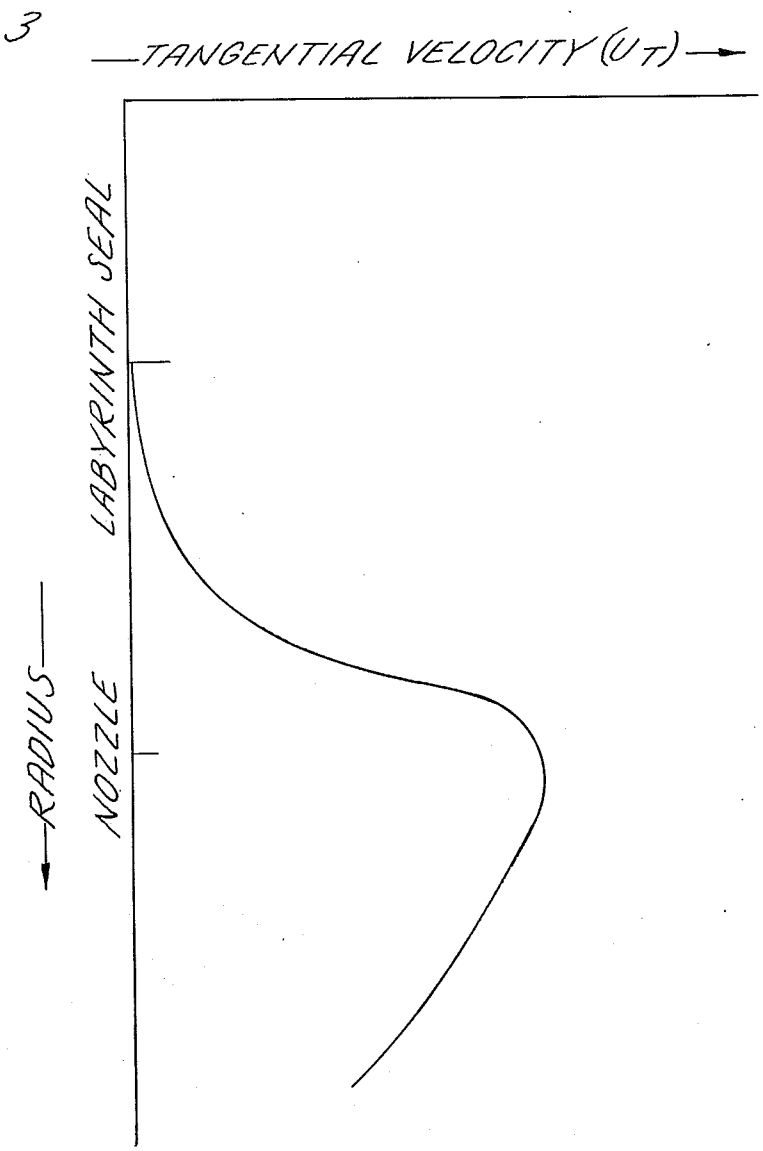
FIG. 3 is a graph showing the relationship between radius and the tangential velocity of the air within the central portion of the cavity.

A gas turbine engine is typical of rotary machines in which the inventive concepts taught herein may be advantageously employed. A portion of the turbine section of such an engine is shown in FIG. 1. The stator assembly is formed of a cylindrical case 14 which has, extending radially inward therefrom, one or more rows of stator vanes 16. A diaphragm 18 extends radially inward from the vanes. The rotor assembly is comprised of at least one disk 20 which has, extending radially outward therefrom, a row of rotor blades 22. A side surface 24 of the disk opposes but is spaced apart from the diaphragm 18. A cavity 26 is formed between the side surface and the diaphragm. A labyrinth seal 28 closes the radially inward end of the cavity. The rows of blades and vanes are alternatingly disposed across an annular flow path 30 which radially bounds the outward end of the cavity 26. A passage 32 extends between the cavity and the flow path. The flow path 30 carries the working medium gases which include products of combustion from a combustion chamber 34 axially downstream through the engine. A plurality of nozzles 36, which are more graphically viewable in FIG. 2, are circumferentially spaced about the passage 32. Relatively cool air is flowable to the nozzles from the compression section of the engine through conduit means 38. Each nozzle has a 90° bend in the direction of rotation of the rotor assembly.

During operation of the engine air is flowed through the nozzles 36 and discharged tangentially in the direction of rotor rotation to cause the air within the cavity 26 to swirl. In the ideal condition the swirling air is accelerated to a tangential velocity which is equal to the tangential velocity of the disk side surface 24 at a corresponding radial location. Operation under the ideal condition, as is discussed below, prevents the radial outflow of air through the disk boundary layer.

As is discussed in the prior art section of the application, relatively cool air is conventionally flowed through the cavity 26 to purge the cavity of hot medium gases. The mass rate of flow of purge air must exceed the mass rate of flow of air pumped radially through the disk boundary layer in order to substantially eliminate ingestion. Advantageously in the present construction, the amount of purge air required to prevent ingestion is reduced through the judicious use of the purge air to decrease the mass flow rate of air pumped through the boundary layer.

A reduction in the boundary layer mass flow rate is achieved by altering the net sum of the radial forces acting upon each particle in the boundary layer. Free vortex and forced vortex phenomenon are employed to effect this reduction.

In a free vortex flow field, which is characteristic of the air in the central region of the cavity 26, the radial pressure gradient is equal in magnitude and opposite in direction to the radial acceleration acting upon each particle.

$$(dP/dr) = \rho\, a_R$$

Where $\rho$ is the density of air;

$(dP/dr)$ is the radial pressure gradient; and $a_R$ is the radial acceleration.

The radial acceleration is expressible in terms of the tangential velocity and radius, $$a_R = (V_T^2/r)$$

Where $V_T$ is the tangential velocity of the air; and $r$ is the radius from the center of rotation to the local region.

Equating the radial pressure gradient in the center of the cavity to the radial acceleration, the gradient becomes expressible in terms of the local tangential velocity of the air.

$$(dP/dr) = \rho\, (V_T^2/r$$

The radial pressure gradient in the central portion of the cavity $(dP/dr)$ is imposed laterally upon the boundary layer adjacent the side surface 24. In contrast to the air in the central portion of the cavity, however, the air in the boundary layer is subjected to forced vortex phenomenon. In forced vortex fields the tangential velocity of the air is equal to the tangential velocity of the adjacent structure.

$$V_T = wr$$

Where $w$ is the angular velocity of the adjacent structure.

Summing the radial forces on a particle in the boundary layer, the net radial force is shown below:

$$F = a_R - (1/\rho\, dP/dr) = ((wr)^2/r) - ((V_T)^2/r$$

Where

F is the net radial force per unit mass on a particle within the boundary layer.

According to the concepts taught herein, air within the cavity is accelerated to a tangential velocity $(V_T)$, which is equal to the local tangential velocity $(wr)$ of the side surface 24 by flowing purge air through the nozzles 36. Resultantly, the net radial force in the local region of the boundary layer becomes 0 and the radial outflow of air ceases.

Cessation of the radial outflow in the vicinity of the passage 32 eliminates recirculation patterns which conventionally cause a portion of the working medium gases to be ingested into the cavity and allows a corresponding reduction in the amount of purge air required to oppose ingeston. In one embodiment the radial clearance between the relatively rotating components of the labyrinth seal is reduced to diminish the supply of purge air, although a small amount of air is continually flowed to limit the temperature of the air within the cavity.

As is viewable in the FIG. 2 embodiment, each of the nozzles is canted radially inward approximately 15° from a tangent line. The canted geometry reduces aerodynamic perturbations caused by the back of the adjacent nozzle. Canting the nozzles axially rearwardly with respect to the engine axis may produce a similar benefit. The essential feature of each nozzle, however, remains the ability of the nozzle to impart tangential swirl to air within the cavity. Further, any device capable of producing the tangential swirl described herein is substitutable for the nozzles of the preferred embodiment shown.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of my invention, that which I claim as new and desire to secure by Letters Patent of the Unites States is:

1. Within a cavity formed between the rotating and stationary elements of a rotary machine, apparatus for decreasing the radial mass flow rate through the air boundary layer which is adjacent to the rotating element wherein said apparatus includes air swirl means for accelerating air within the cavity to a tangential velocity which approximates the tangential velocity of the rotating element at a corresponding radial position.

2. The invention according to claim 1 wherein said air swirl means comprises a pluraity of nozzles disposed circumferentially about the cavity and adapted so as to discharge air flowing therethrough during operation of the engine in a substantially tangential direction.

3. The invention according to claim 2 wherein said nozzles extend from the stationary element.

4. A rotary machine structure comprising a stationary element having a diaphragm which extends in an essentially radial direction and a rotating element having a side surface which is spaced apart from said diaphragm to form a cavity therebetween, and including, disposed across the radially outward end of the cavity means for swirling the air within the outward portion of the cavity at a tangential velocity which approximates the tangential velocity of the rotating element to impose upon the air within the air boundary layer, which is adjacent the rotating element, a radial pressure gradient which is equal in magnitude and opposite in direction to the radial acceleration of the air within the boundary layer.

5. The invention according to claim 4 wherein said swirling means is a plurality of circumferentially disposed air injection nozzles.

6. Apparatus for preventing the radially inward ingestion of working medium gases from the flow path of a gas turbine engine into an internal cavity between the rotating and stationary elements of the machine, comprising:

a plurality of a nozzle circumferentially disposed at the radially outward end of the cavity and so oriented as to cause the air flowing therefrom during operation of the engine to accelerate the air within the outward portion of the cavity to a tangential velocity which is substantially equal to the tangential velocity of the rotating element at a corresponding radial position.

7. In the gas turbine engine of the type having a cavity located radially inward of the flow path of the working medium gases between the rotating and stationary elements of the engine, a method for preventing the ingestion of working medium gases from the flow path into the cavity, comprising:

flowing air tangentially into the radially outer end of the cavity so as to accelerate the air within the cavity to a tangential velocity which is substantially equal to the tangential velocity of the rotor at a corresponding radial location.

* * * * *